US010828528B1

(12) United States Patent
Romero

(10) Patent No.: US 10,828,528 B1
(45) Date of Patent: Nov. 10, 2020

(54) HANDLEBAR-PLATE EXERCISE DEVICE

(71) Applicant: Armando Romero, Miami Springs, FL (US)

(72) Inventor: Armando Romero, Miami Springs, FL (US)

( * ) Notice: Subject to any disclaimer, the term of this patent is extended or adjusted under 35 U.S.C. 154(b) by 0 days.

(21) Appl. No.: 16/674,263

(22) Filed: Nov. 5, 2019

(51) Int. Cl.
*A63B 21/055* (2006.01)
*A63B 21/075* (2006.01)
*A63B 21/00* (2006.01)

(52) U.S. Cl.
CPC ..... *A63B 21/4035* (2015.10); *A63B 21/0557* (2013.01); *A63B 21/075* (2013.01)

(58) Field of Classification Search
CPC ..... A63B 21/0004; A63B 21/02; A63B 21/04; A63B 21/0407; A63B 21/055; A63B 21/0552; A63B 21/0557; A63B 21/06; A63B 21/0601; A63B 21/0602; A63B 21/0603; A63B 21/0604; A63B 21/0605; A63B 21/0606; A63B 21/0607; A63B 21/068; A63B 21/072; A63B 21/0722; A63B 21/0724; A63B 21/075; A63B 21/40; A63B 21/4001; A63B 21/4027; A63B 21/4033; A63B 21/4035; A63B 21/4039; A63B 21/4041; A63B 21/4043; A63B 23/02; A63B 23/0205; A63B 23/0222; A63B 23/035; A63B 23/03516; A63B 23/12; A63B 2023/003; A63B 2023/006
USPC ..... 482/99; D21/679–685, 691, 797, 798
See application file for complete search history.

(56) References Cited

U.S. PATENT DOCUMENTS 6,312,364 B1 * 11/2001 Selsam ..... A63B 21/06 206/501
2014/0256522 A1 * 9/2014 Holt, IV ..... A63B 21/0602 482/110
2016/0375294 A1 * 12/2016 Grimaud ..... A63B 21/072 482/93

* cited by examiner

*Primary Examiner* — Loan B Jimenez
*Assistant Examiner* — Zachary T Moore
(74) *Attorney, Agent, or Firm* — Ruben Alcoba, Esq.

(57) ABSTRACT

An exercise device that is composed of at least one ergonomic plate that has two end handles. In preferred embodiments, the device will be used with resistance bands. The handlebar-plate exercise device is flat and is made so that a first element of the device can connect to a second, third and fourth element of the device by using a friction-based peg system.

1 Claim, 6 Drawing Sheets

HANDLEBAR-PLATE EXERCISE DEVICE

BACKGROUND

The present disclosure relates to an exercise device that is composed of at least one ergonomic plate that has two end handles. In preferred embodiments, the device will be used with resistance bands. In one embodiment, the handlebar-plate exercise device is flat and has eight sides, four of them with a round radius to obtain a gentle but solid grip.

The invention is ergonomic in its form, translational in its design, and is composed of at least one handlebar-plate exercise device. When using more than one plate, the device will use a friction-based pin system to lock or store the interchangeable, ergonomic, translational exercise handlebar-plates of the exercise device.

In today's world, exercise is never convenient or routine. Even though, regular exercise is one of the best things that a human can do for his or herself, most humans fail to perform it regularly. Most people whom start exercise programs do not stick to them. Others buy expensive memberships, indoor equipment, stationary bicycles, rowing machines, and barbells, only to abandon their use after an initial period of enthusiastic use.

In the invention the word "stick" has two important connotations. First is as one of mankind's oldest and simplest tool, and secondly as the phrase "stick to it" as a directive. To keep up on an exercise program and have success it needs to be routine.

The present invention was conceived in order to encourage easy workout programs that can be performed throughout the day. The device was designed not to be monotonous, to remove obstacles, to hold the user accountable for its use and to be accessible.

To that end, the invention was created. The device (also referenced in this application as the "stick") is a handlebar-plate exercise device that can be used anywhere and that is easily storable and multi-useable.

The handle component of the present handlebar-plate exercise device may reduce the cumulative trauma of the hand, wrist or arm when the device is used. The handlebar-plate exercise device is designed after an eight-sided tennis butt with rounded instead of a beveled edge for ease of grip.

An embodiment of the present invention can also be made from a one-piece stiff yet gentle radius HDPE Marine Plastic that will hold up for many years of use.

Another embodiment of the present invention uses natural latex rubber resistance bands to maximize workouts. The bands are used by looping them around the openings of the handlebar-plates of the device and to lock them in place around the device and resistance points that can include body parts of the user or fixed objects that are near the user.

The present invention eliminates the need of using long metal bars or single resistance bands that can be hard on the hands of the user when used. The present invention makes the union of bar together with handle and resistance bands simple and convenient for use.

The present device can be used by anyone wishing to get in shape by stretching and strengthing the muscles, tendons and ligaments of the user. The inventor of the present invention designed the stick so that it could be used in while laying in bed, while sitting, while watching television, while at work, while playing sports, while in the shower or while in the pool—the device can be used at any time and at any place.

Each component of the device can be used as a stand-alone piece or as a composite exercise device.

For the foregoing reasons, there is a need for the handlebar-plate exercise device that eliminates the necessity of having multiple exercise equipment or accessories to perform a variety of resistance-based stretching, strengthening and exercise routines.

SUMMARY

The present invention is a handlebar-plate exercise device. The device, in its simplest form, has a main first eight-sided plate that has a left and right handle that extend from the left and the right sides of the device. The first eight sided plate defines an aperture that is used for positioning the hands of a user and for holding resistance band. The device uses at least one closed looped resistance band that is placed and secured around the apertures of the device.

Embodiments will include a second eight sided plate that will overlap over the sides of the first eight sided plate, the plates will be secured using a left and a right peg that will insert within a left and a right peg aperture of the first and second eight sided plates. The addition of the second eight sided plate will add weight to the exercise device of the present invention. In addition, the second eight sided plate can be placed on a surface so that it serves as a platform for the first eight sided plate when a bottom side of the first eight sided plate is inserted within an aperture of the second eight sided plate.

A further embodiment of the present invention will use a pair of seven sided plates that define a handle and a peg aperture. The seven sided plates will mount on the left and the right pegs after the first and second eight sided pegs are secured together. The seven sided plates are used on the present invention to increase the weight of the device. Yet, they can also be used individually to perform cardio exercises, such as dancing, shadow-boxing, water aerobics, walking or riding a spinning bike.

An object of the present invention is to provide an ergonomic exercise device that is compact.

Yet another object of the present invention is to provide an exercise device that uses resistance to increase muscle mass.

Still another object of the present invention is to provide an exercise device that will allow a user to perform multiple exercises while using one device.

Yet still another object of the present invention is to provide an exercise device that allows a user to control the weight of the device.

A further object of the present invention is to provide a user with an exercise device that can be used in multiple environments.

DRAWINGS

These and other features, aspects, and advantages of the present invention will become better understood with regards to the following description, appended claims, and drawings where:

Figure 1:
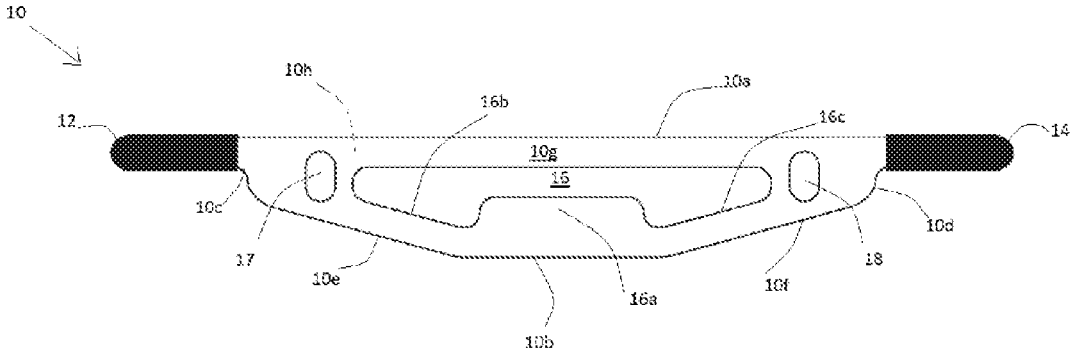
FIG. 1 shows a front view of the first eight sided plate of the present invention.
Figure 2:
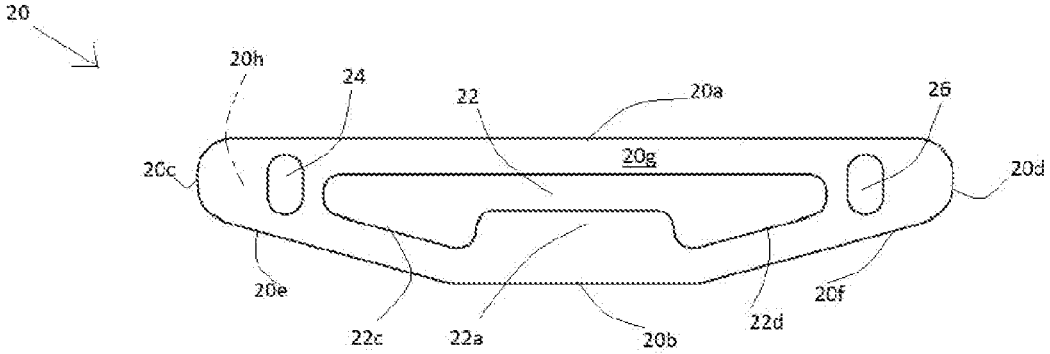
FIG. 2 shows a front view of the second eight sided plate of the present invention.
Figure 3:
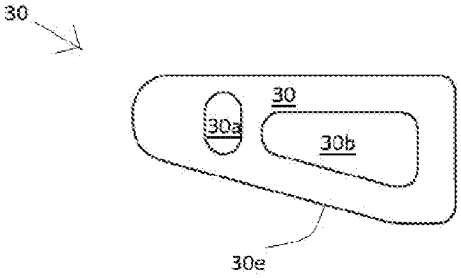
FIG. 3 shows a front view of the left seven sided plate of the present invention.
Figure 4:
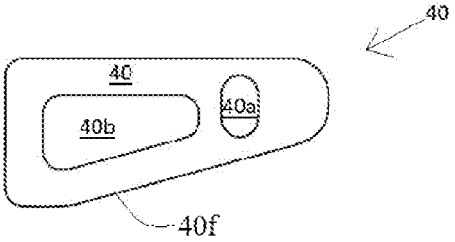
FIG. 4 shows a front view of the right seven sided plate of the present invention.
Figure 5:
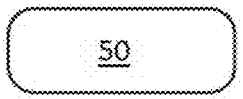
Figure 6:
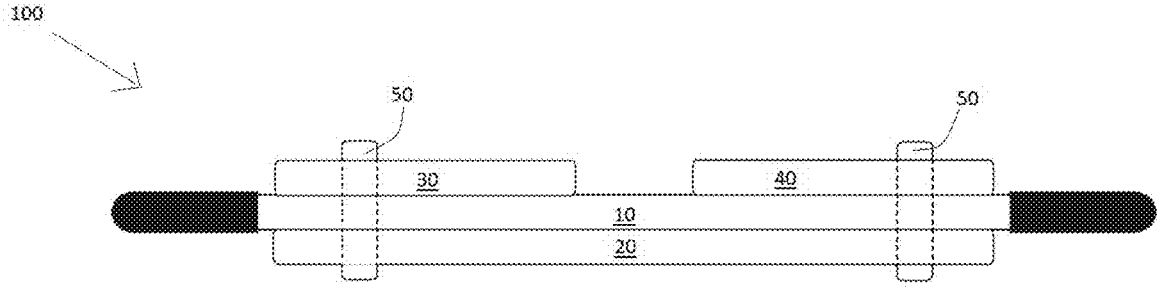
Figure 7:
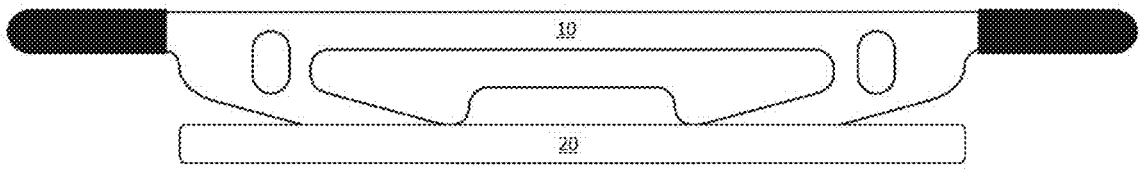
Figure 8:
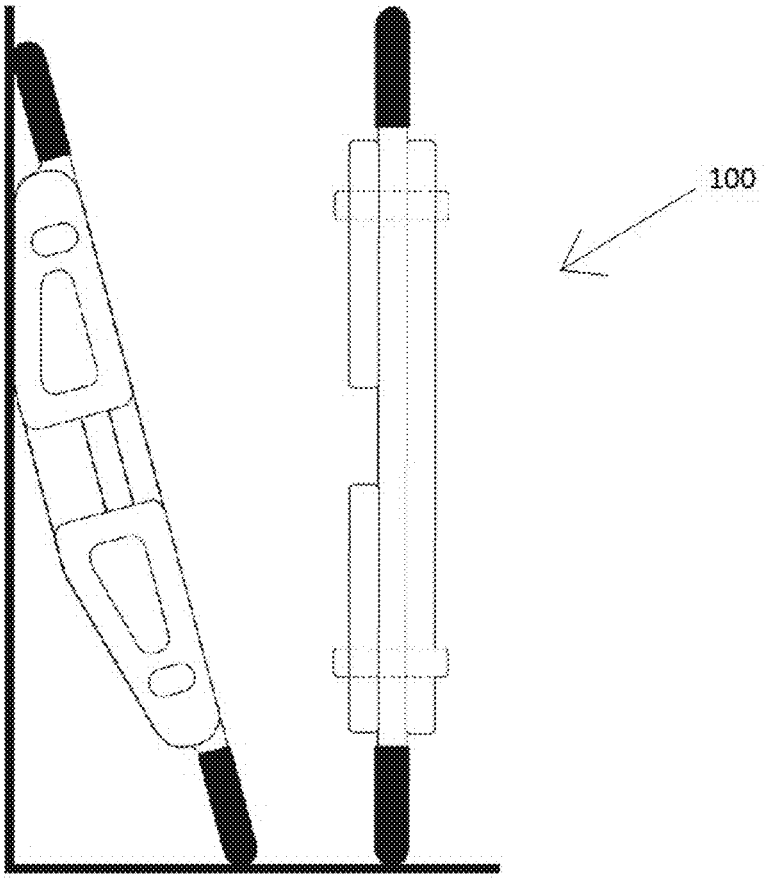
Figure 9:
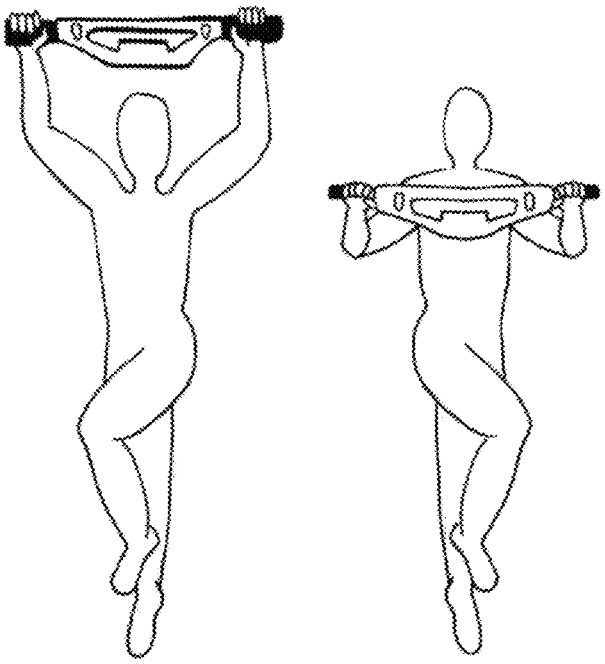
Figure 10:
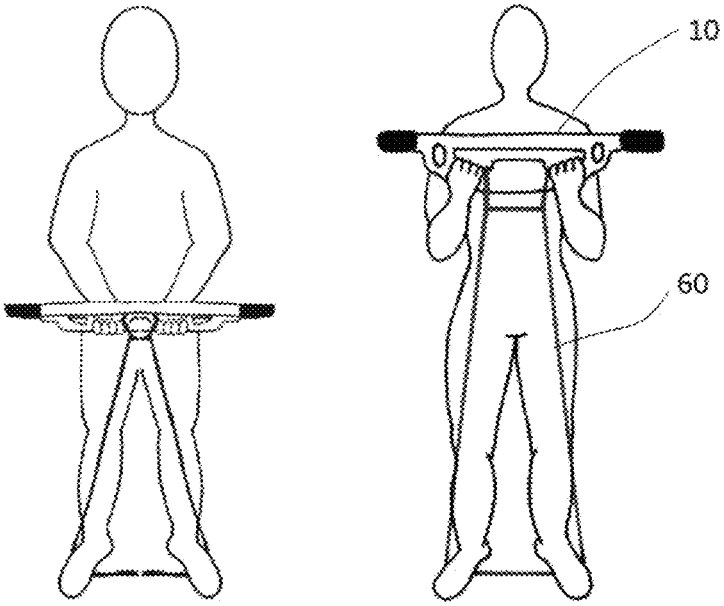
Figure 11:
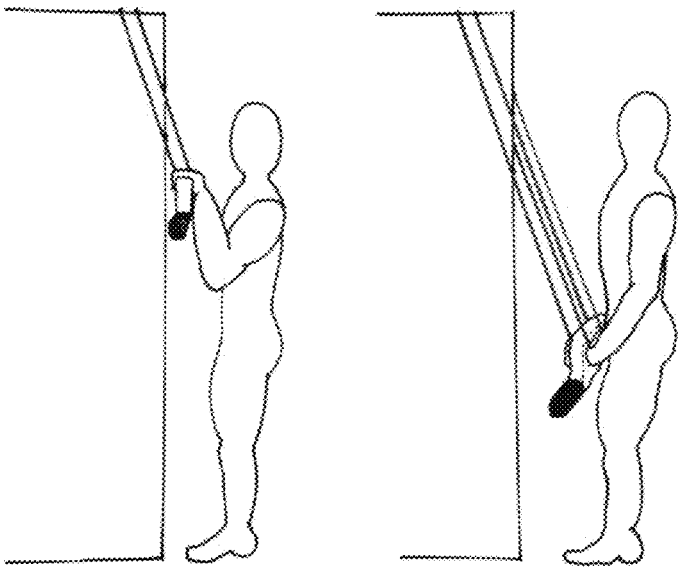
Figure 12:
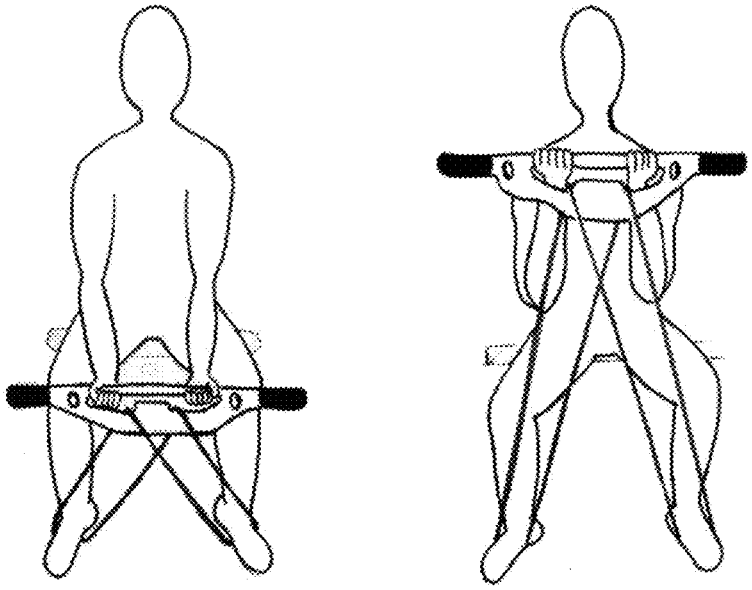
Figure 13:
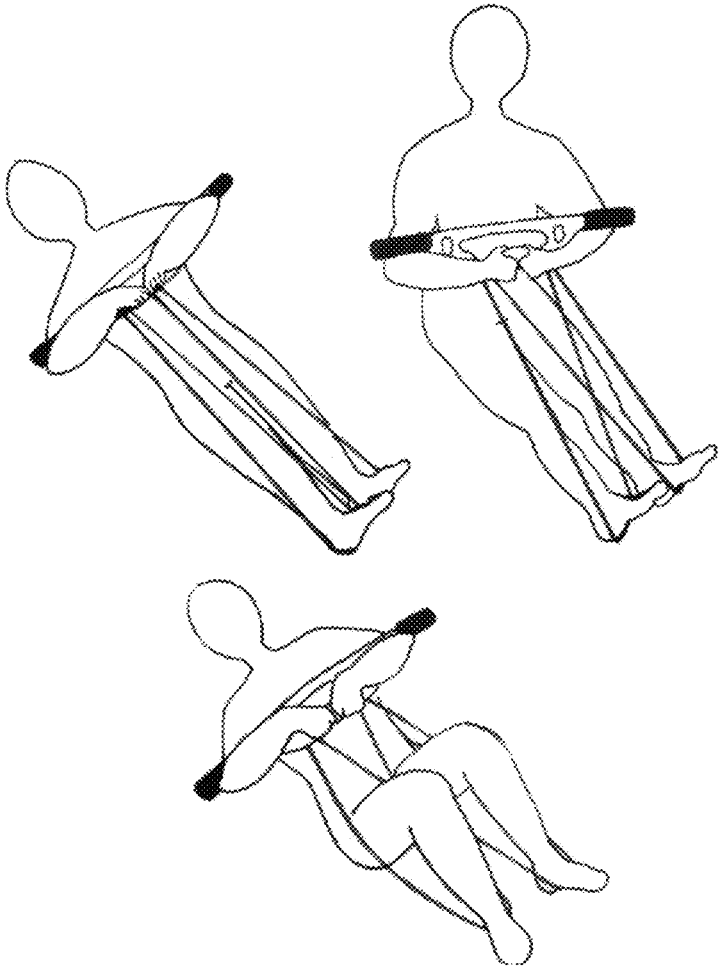

FIG. 5. Shows a peg that is used the plates of the present invention;

FIG. 6 shows a top elevation view of the present invention wherein the plates are secured by the pegs;

FIG. 7 shows a front view of the present invention wherein the first eight sided plate is mounted on the second eight sided plate;

FIG. 8 shows how the present invention can be placed on a wall in a resting state;

FIG. 9 shows a first aerobic standing balance exercise routine;

FIG. 10 shows a second exercise routine that uses at least one band for resistance;

FIG. 11 shows an exercise routine using a fixed object to provide resistance;

FIG. 12 show a sitting exercise routine using the at least one resistance band; and FIG. 13 shows a laying exercise routing using the at least one resistance band.

DESCRIPTION

As seen in FIGS. 1-7 and 10, the present invention is a handlebar-plate exercise device 100. The exercise device 100 comprises a first eight sided plate 10, the first eight sided plate has a first top side 10*a* and a first bottom side 10*b* that are parallel to each other and the first top side 10*a* is three times a length of the first bottom side 10*b*, a first left side 10*c* and a first right side 10*d* that run perpendicularly downward from the first top side 10*a*, a first left upward side 10*e* that connects the first left side 10*c* to the first bottom side 10*b* and a first right upward side 10*f* connects the first right side 10*d* to the first bottom side 10*b*, and a first front side 10*g* and a first rear side 10*h*, a first left handle 12 extends outward from the first left side 10*c* and a first right handle 14 extend outward from the first right side 10*d*, wherein the first eight sided plate 10 defines a first aperture 16 that defines a first raised central ridge 16*a*, a first upward sloped left side 16*b* that runs parallel to the first left upward side 10*e* and a first upward sloped right side 16*c* that runs parallel to the first right upward side 10*f*.

In another embodiment of the present invention, the exercise device 100 comprises of a second eight sided plate 20, the second eight sided plate has a second top side 20*a* and a second bottom side 20*b* that are parallel to each other and the second top side 20*a* is three times the length of the second bottom side 20*b*, a second left side 20*c* and a second right side 20*d* that run perpendicularly downward from the second top side 20*a*, a second left upward side 20*e* that connects the second left side 20*c* to the second bottom side 20*b* and a second right upward side 20*f* that connects the second right side 20*d* to the second bottom side 20*b*, and a second front side 20*g* and a second rear side 20*h*, wherein the second eight sided plate 20 defines a second aperture 22 that defines a second raised central ridge 22*a*, a second upward sloped left side 22*b* that runs parallel to the second left upward side 20*c* and a second upward sloped right side 22*c* that runs parallel to the second right upward side 20*f*, wherein the first eight sided plate 10 defines a first left peg 17 aperture and a first right peg aperture 18, and wherein the second eight sided plate 20 defines a second left peg aperture 24 and a second right peg aperture 26. A left peg 50 that inserts within the left peg apertures 17, 24 of the first 10 and second 20 eight sided plates. And, a right peg 50 that inserts within the right peg apertures 18, 26 of the first 10 and second 20 eight sided plates.

In still another embodiment of the invention, the exercise device 100 comprises of a seven sided left plate 30 that defines a first handle aperture 30*b* and a first peg aperture 30*a*, the seven sided left plate 30 mounts on the left peg 50 after left peg 50 has been inserted within the first 10 and second 20 eight sided plates. The seven sided left plate 30 has a left upward side 30*e*. And, a seven sided right plate 40 that defines a second handle aperture 40*b* and a second peg aperture 40*a*, the seven sided right plate 40 mounts on the right peg 50 after the right peg 50 has been inserted within the first 10 and second 20 eight sided plates. The seven sided right plate 40 has a right upward side 40*f*.

In preferred embodiments of the invention, the exercise device 100 will comprise of at least one closed resistance band 60, the at least one closed resistance band 60 is secured within the apertures 16, 17, 18, 24, 26, 30*a* or 40*a* of the handlebar-plate exercise device 100.

In preferred embodiments of the invention, the left upward side 10*e*, 20*e*, 30*e* and the right upward side 10*f*, 20*f*, 40*f* of the first eight sided plate 10, the second eight sided plate 20, the seven sided left plate 30 and the seven sided right plate 40 have an upward slope that is about fifteen degree.

Some suggested exercises using the present invention are shown in FIGS. 9 thru 13.

An advantage of the present invention is that it provides an ergonomic exercise device that is compact.

Yet another advantage of the present invention is that it provides an exercise device that uses resistance to increase muscle mass.

Still another advantage of the present invention is that it provides an exercise device that allows a user to perform multiple exercises while using one device.

Yet still another advantage of the present invention is that it provides an exercise device that allows a user to control the weight of the device.

A further advantage of the present invention is that it provides a user with an exercise device that is used in multiple environments.

Yet a further advantage of the present invention is that it provides an exercise device that allows motion stretching, promotes flexibility and balancing.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed:

1. A handlebar-plate exercise device comprising:

a first eight sided plate, the first eight sided plate has a first top side and a first bottom side that are parallel to each other and the first top side is three times a length of the first bottom side, a first left side and a first right side that run perpendicularly downward from the first top side, a first left upward side that connects the first left side to the first bottom side and a first right upward side that connects the first right side to the first bottom side, and a first front and a first rear side, a first left handle extending outward from the first left side and a first right handle extending outward from the first top right side, wherein the first eight sided plate defines a first aperture that defines a first raised central ridge, a first upward sloped left side that runs parallel to the first left upward side and a first upward sloped right side that runs parallel to the first right upward side;

a second eight sided plate, the second eight sided plate has a second top side and a second bottom side that are parallel to each other and the second top side is three times a length of the second bottom side, a second left side and a second right side that run perpendicularly downward from the second top side, a second left upward side that connects the second left side to the second bottom side and a second right upward side that connects the second right side to the second bottom side, and a second front side and a second rear side, wherein the second eight sided plate defines a second aperture that defines a second raised central ridge, a second upward sloped left side that runs parallel to the second left upward side and a second upward sloped right side that runs parallel to the second right upward side, wherein the first eight sided plate defines a first left peg aperture and a first right peg aperture, and wherein the second eight sided plate defines a second left peg aperture and a second right peg aperture;

a left peg that inserts within the first and second left peg apertures of the first and second eight sided plates;

a right peg that inserts within the first and second right peg apertures of the first and second eight sided plates;

a seven sided left plate that defines a first handle aperture and a first peg aperture, the seven sided left plate mounts on the left peg after the left peg has been inserted within the first and second eight sided plates; and a seven sided right plate that defines a second handle aperture and a second peg aperture, the seven sided right plate mounts on the right peg after the right peg has been inserted within the first and second eight sided plates.

* * * * *